United States Patent [19]

Stryker

[11] 4,165,753

[45] Aug. 28, 1979

[54] SMOKER'S PIPE

[76] Inventor: Timothy J. Stryker, 94 Hammersmith Apts., Danbury, Conn. 06810

[21] Appl. No.: 743,199

[22] Filed: Nov. 18, 1976

[51] Int. Cl.[2] ..... A24F 1/14; A24F 1/30

[52] U.S. Cl. ..... 131/173; D27/3

[58] Field of Search ..... 131/173, 223, 194, 195; 220/90.0, 90.4, 94.7; D27/3-5

[56] References Cited

U.S. PATENT DOCUMENTS

| | | | |
|---|---|---|---|
| 1,967,438 | 7/1934 | Hartzes | 131/173 |
| 3,703,179 | 11/1972 | Nubla | 131/173 |
| 3,872,872 | 3/1975 | Kahler | 131/229 X |
| 3,881,499 | 5/1975 | McFadden et al. | 131/173 |
| 4,029,109 | 6/1977 | Kahler | 131/173 |

*Primary Examiner*—Stephen C. Pellegrino

*Attorney, Agent, or Firm*—Beveridge, DeGrandi, Kline & Lundsford

[57] ABSTRACT

A smoker's pipe has a mouthpiece opening formed at the intersection of the walls of a smoke-receiving housing. The smoke is cooled and humidified by passing it upwardly through a body of water, the smoke being introduced into the water by a bubble forming means. The bubble forming means has a plurality of apertures which break the smoke into a plurality of bubble-forming streams to reduce the size of the bubbles and to increase the interaction between the bubbles and the water. Carryover of water into the mouthpiece is minimized by providing a deentrainment chamber in the flow path between the smoke cooling chamber and the mouthpiece. In the deentrainment chamber, the smoke ascends and the water descends to drain gravitationally through a check valve near the bottom of the deentrainment chamber. A modular system is disclosed wherein units may be added or removed to vary the number of cooling stages in the pipe.

7 Claims, 11 Drawing Figures

FIG. 2
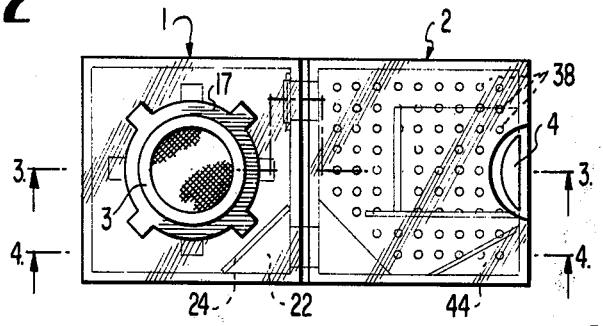
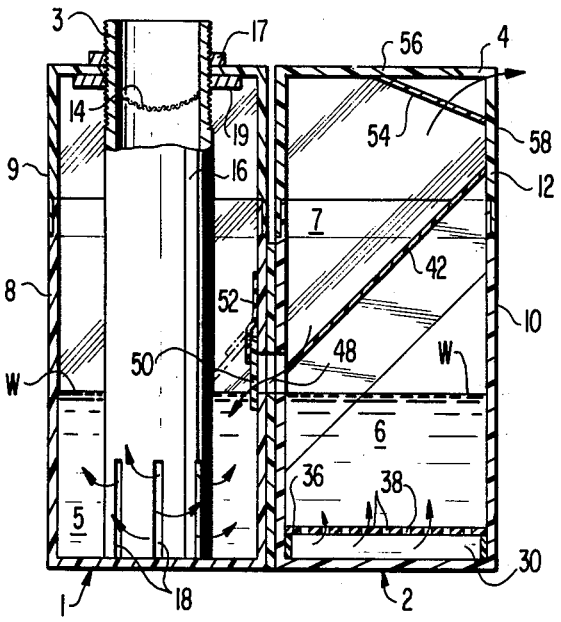
FIG. 3
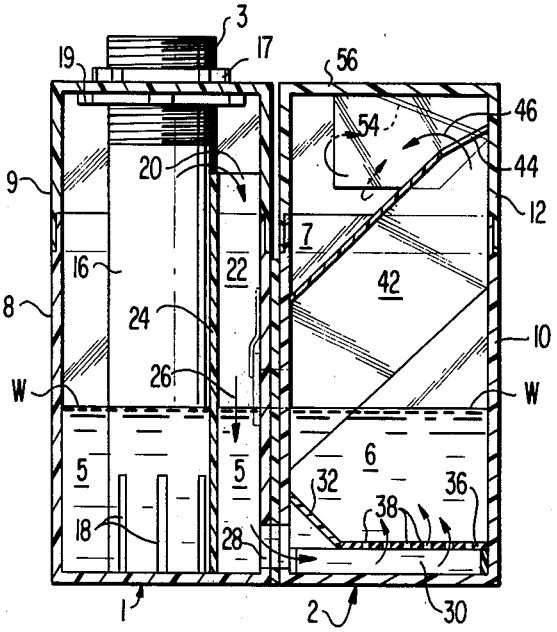
FIG. 4
FIG. 5
(PRIOR ART)
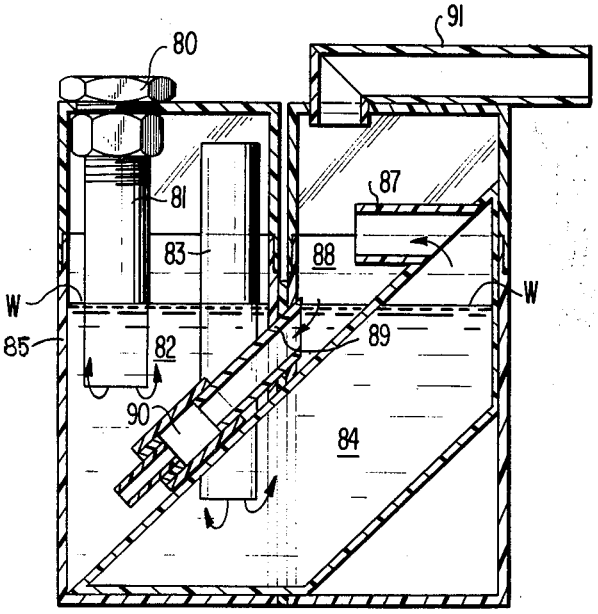

SMOKER'S PIPE

BACKGROUND AND SUMMARY OF THE INVENTION

This invention relates to pipes for smoking tobacco and other combustible materials. The invention pertains in part to a mouthpiece construction which is suitable to a wide variety of pipes, but the remaining features hereof are peculiar to devices referred to generally as waterpipes, wherein the smoke generated by the combustible material is passed upwardly in the form of bubbles through a body of water which cools and humidifies the smoke before it reaches the smoker.

Nubla U.S. Pat. No. 3,703,179 discloses a submerged filter in a waterpipe; and, McFadden et al U.S. Pat. No. 3,881,499 describe a system which utilizes two or four tubes which carry smoke into the lower liquid area of the cooling chamber of a waterpipe. The Nubla pipe would be incapable of breaking the smoke into small bubbles unless the filter is so fine that inhalation is extremely difficult. The McFadden et al device provides only one bubble-forming aperture for each smoke inlet pipe, therefore rendering it incapable of maximization of appropriate bubble-forming means.

One feature of the present invention is based upon the inventor's recognition that the cooling and humidification of smoke is dependent upon the total surface area of the smoke bubbles, and that this surface area for a given volume of smoke may be increased by reducing the size and increasing the number of bubbles. This is achieved by providing a given smoke inlet conduit with a bubble-forming means which has a plurality of spaced apart smoke-releasing apertures for breaking the smoke into a plurality of bubble-forming streams. These apertures may take various forms, including but not limited to slits and circular perforations disclosed in this application, such apertures preferably being separated by a distance greater than their dimension to prevent reunification of the small bubbles into larger bubbles.

In prior art pipes made and sold by the inventor, a deentrainment chamber has been provided immediately preceding the mouthpiece, the deentrainment chamber giving the froth formed by the smoke and water a residence time, permitting the smoke to be released from the water to avoid the inhalation of water through the mouthpiece. This is particularly important in pipes of small dimensions where the mouthpiece is close to the smoke cooling chamber. In prior devices, the deentrainment chamber has been of commensurate extent and gravitational potential as the upstream smoke cooling chamber, and a check valve was provided in an upper part of the deentrainment chamber.

The deentrainment chamber of the present invention is of an improved design which optimizes the utilization of volume within the pipe, this being achieved by providing a gravitational drain means with a drain opening located near the bottom of the deentrainment chamber, permitting the deetrainment chamber to discharge substantially all of its contents rather than constantly maintaining a substantial volume and depth of liquid therein.

A third feature of the present invention pertains to a mouthpiece design which is not essentially limited to use in connection with waterpieces. Previously, various types of holes, tubes and bits have served as the mouthpieces of pipes. To the knowledge of the present inventor, there have been no proposals simplifying the mouthpiece design to that it may be formed directly in a pipe housing which has plural intersecting walls.

According to the preferred embodiment of the invention, a pipe is provided with a smoke receiving chamber formed of a plurality of intersecting walls, and a mouthpiece opening is formed in at least two of the walls at their intersection, enabling a smoker's lips to be placed respectively against the two walls to surround the mouthpiece opening. This avoids undesirable protrusions from the pipe housing and affords a natural and comfortable means for drawing smoke from a pipe housing.

The previously-mentioned features of the invention are applicable to single stage pipes or multiple stage pipes.

Another feature of the present invention relates to multiple-stage waterpipes wherein the smoke is passed serially through a series of cooling stages, each of which is provided with a body of water through which smoke bubbles ascend for cooling and humidification. Multiple-stage pipes have been known, an early version thereof being shown by the Abizaid U.S. Pat. No. 848,424. If one had desired to increase the number of smoke cooling stages in such devices, it would have been necessary to remanufacture them by adding and assembling additional vessels, tubes and stoppers.

According to the present invention, a waterpipe may be formed of a plurality of interconnectible units or modules, constructed so that additional modules may be added therebetween to increase the number of smoke cooling stages. The insertable modules each would comprise a hollow body having at its opposite ends an inlet end and an outlet end, the hollow body including a vessel provided with a lower liquid space and an upper air space. An upwardly-extending passage in the module communicates from a point below the air space to a point at the elevation of the air space, and a downwardly extending passage leads into the lower liquid space from a point above the liquid space. Joint means are provided for connecting the inlet end of the hollow body to another module, and joint means are also provided for connecting the outlet end of the hollow body to another module. Preferably, a plurality of the modules are arranged in vertical succession, but horizontal arrangements are also suitable according to the invention. In an assembly of the modules, it is preferred to provide the modules with joints which are identical at their respective inlet ends and are identical at their respective outlet ends, thereby facilitating the insertion of additional modules into the system.

BRIEF DESCRIPTION OF THE DRAWINGS

FIG. 2 is a plan view of the pipe of FIG. 1.

FIG. 3 is a sectional view of the pipe of FIG. 1 as seen along the line 3—3 in FIG. 2.

FIG. 4 is a sectional view of the pipe of FIG. 1, as seen along the line 4—4 in FIG. 2.

FIG. 5 is a sectional view of a prior art pipe having two smoke cooling stages.

BRIEF DESCRIPTION OF THE PREFERRED EMBODIMENTS

Two Stage Model

Figure 1:
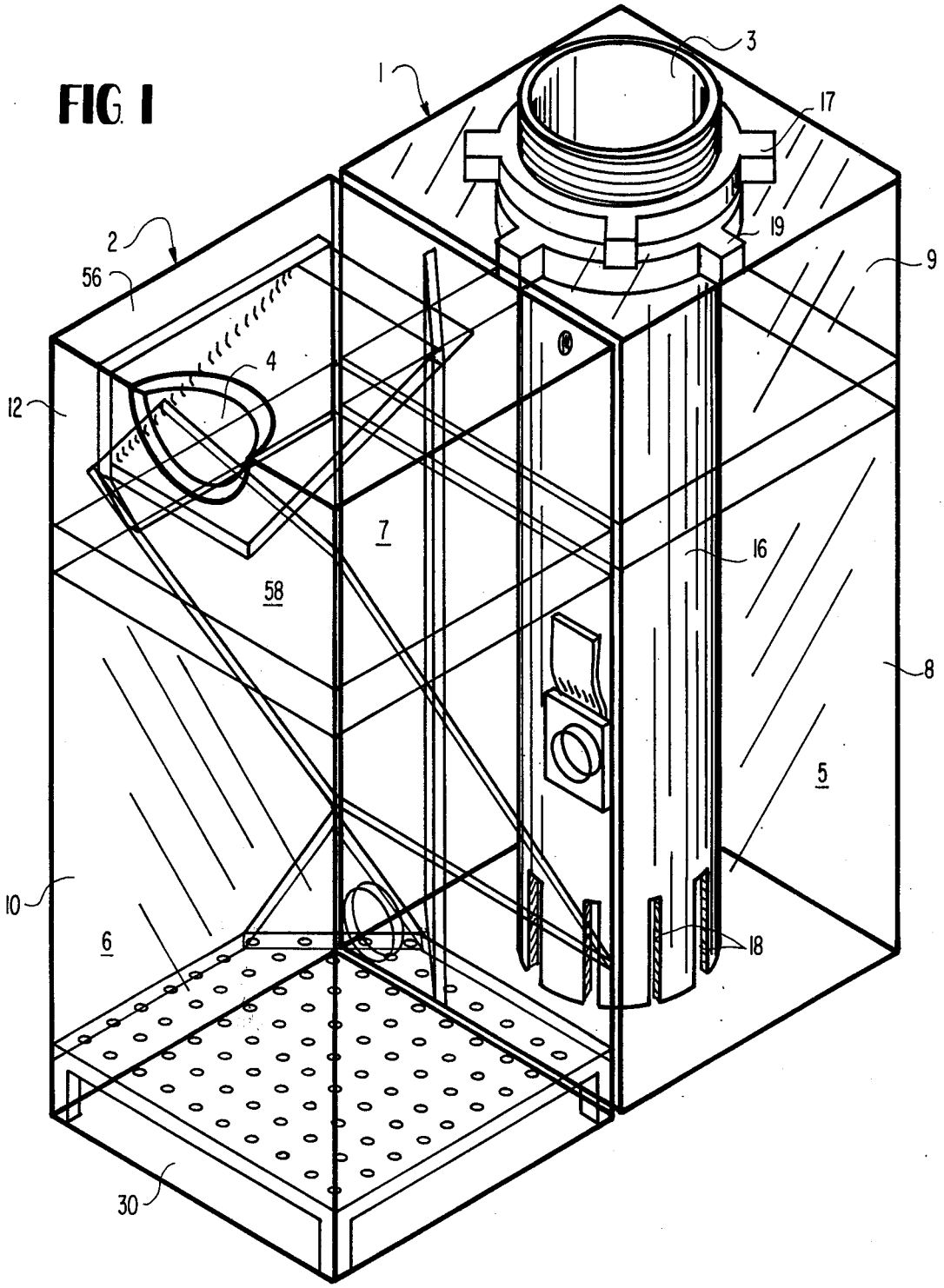
FIG. 1 is a perspective view of a pipe constructed according to the invention and provided with two cooling stages, each of which has a multiple-apertured bubble forming means for the smoke.

The pipe shown in FIGS. 1-4 is formed of a pair of interconnected boxes 1 and 2 which support and/or form the operative elements thereof. A smoker places combustible smoking material in the bowl 3 and ignites it, drawing on the mouthpiece opening 4 while placing his lips on the top and rear wall of the box 2. The partial vacuum caused by this action causes smoke from bowl 3 to form bubbles which pass upwardly through water in the primary smoke cooling chamber 5 in box 1, then reform into bubbles which pass upwardly through a secondary smoke cooling chamber 6 in box 2, pass through a deentrainment chamber 7 in box 2 where liquid is permitted to settle from the smoke, and then to the mouthpiece opening.

The box 1 has a base section 8 and a removable cover 9; and, the box 2 has a base 10 and a removable cover 12. The bowl 3 for tobacco or other smoking material has a screen 14 or other perforate bottom and is located at the upper end of a conduit or tube 16. The tube 16 is affixed to the cover 12 of box 1 by threaded nuts 17 and 19. The midportion of tube 16 provides a smoke inlet passage to the first cooling stage, and its lower end is provided with a plurality of radiating openings in the form of elongated slits 18 which are located in a submerged portion of the primary smoke-cooling chamber 5. The slits 18 provide bubble-forming smoke releasing apertures which are spaced apart by a distance at least equal to their width, and they serve to break the incoming smoke into a plurality of bubble-forming streams.

When air is drawn into the pipe, smoke produced by combustible material in the bowl 3 passes downwardly through the tube 16 from a point above the liquid space downwardly into the liquid space of the chamber. The smoke exits tube 16 through the slits 18, forming streams of bubbles which rise through the lower liquid space of the primary chamber. Intimate contact between the bubbles and the water cools the smoke which then moves into the upper air space of the primary chamber 5 to a smoke outlet opening 20. In this preferred embodiment, as shown in FIGS. 2 and 4, opening 20 is the upper end of a vertical passage 22 formed in the primary chamber by a vertical baffle 24 which is bonded to the rear wall, left sidewall and bottom wall of the base 8 of box 1.

The second cooling stage receives smoke from the chamber 5, the passage 22 serving as the smoke inlet passage for the second stage. Passage 22 carries smoke from a point elevated above the liquid space in both chambers 5 and 6, downwardly into the liquid space of the secondary chamber 6. This downward flow is shown by the arrow 26 in FIG. 4, where it will be seen that aligned apertures in the lower sections of the boxes 1 and 2 form an opening 28 which carries smoke from the lower end of passage 22 into a submerged chamber 30 at the bottom of the secondary smoke cooling chamber.

The chamber 30 has as its upper boundary a triangular inclined impervious piece 32 and a horizontal perforated piece 36, the latter having a plurality of apertures 38 which face upwardly to release smoke into the water contained in the lower liquid space of the secondary smoke cooling chamber. The distance between adjacent apertures 38 is no less than the dimensions across one aperture so that the apertures will form a plurality of streams of smoke which form small bubbles, maximizing the extent of contact between the rising smoke and the cooling liquid in the secondary chamber 6.

The intimate contact between the rising smoke and the liquid in the secondary chamber 6 produces a substantial amount of froth or foam which preferably is broken down before the smoke proceeds to the mouthpiece 4 of the pipe. According to the preferred embodiment of the invention, the smoke and liquid carryover are passed through a deentrainment chamber 7 which is formed in an upper part of the box 2, the smoke cooling chamber 6 being separated from the deentrainment chamber 7 by a baffle 42 which is sealed and/or contacts the interior walls of the box 2, except at one corner where the baffle 42 is cut away to form an opening 44. This opening 44 enables the cooled smoke and froth to pass upwardly from the secondary smoke cooling chamber 6 into the deentrainment chamber 7 as shown by the arrow 46 in FIG. 4. As the froth descends along the inclined baffle 42, the bubbles thereof break to release the smoke, leaving a body of water in the lower right forward corner of the deentrainment chamber 7. Adjacent to this corner, there is a drain opening 48 shown in FIG. 3 for discharging liquid gravitationally from the deentrainment chamber 7 into the primary smoke cooling chamber 5. The opening is normally open to permit drainage of the deentrainment chamber 7, but when the user draws on the pipe to create a subatmospheric pressure in the deentrainment chamber, the opening 48 is closed by a check valve means. The check valve is preferably a sealing pad 50 supported on a flexible piece 52 which enables the sealing pad 50 to move from the closed position illustrated in solid lines to the open position illustrated in broken lines.

The smoke which is in the upper part of the deentrainment chamber 7 passes vertically around the right edge of inclined baffle 54 and exits the pipe through the mouthpiece opening 4.

The mouthpiece 4 is formed in the orthogonally-intersecting planar top wall 56 and rear wall 58 of the box 2, the opening being arcuately cut or molded in both of these walls at their intersection so that the smoker's lips may be placed against the two walls to surround the mouthpiece opening as the smoker draws on the pipe. This mouthpiece promotes compactness as it eliminates any protrusions from the pipe housing, and it enables a smoker to obtain easily a tight seal about the lips. The mouthpiece is easily manufactured by molding or milling, and a wide variation in sizes is easily achieved to give the smoker an open free draw. The edge of the housing may be of beveled or rounded configuration adjacent to the mouthpiece opening, and the smoker's lips will comfortably fit on the mouthpiece when the intersecting walls meet at angles ranging from about 60° to 120°.

For a comparison between the pipe of the present invention and a prior art pipe developed by the inventor, reference is made to FIG. 5 which shows a two-stage pipe having a bowl 80 at the upper end of a tube 81 which carries smoke downwardly into the liquid in a primary chamber 82. The entering smoke is released downwardly through a single opening which will cause it to form large bubbles for a less-effective cooling action than the present invention. Smoke collected at the upper end of the chamber 82 then passes downwardly through the tube 83 into liquid in the diagonally-oriented secondary smoke cooling chamber 84 which extends diagonally upwardly from the lower end of box 85 into the box 86. Although not shown, the width, i.e., the left-to-right measurement of the chamber 84 is less than that of the containing boxes. The tube 83 releases smoke downwardly in a single stream into the chamber 84, the ascending smoke and froth passing horizontally through tube 87 into the deentrainment chamber 88. The deentrainment chamber 88 extends upwardly from the bottom of the box to the upper inclined end of a drain tube 89 which drains liquid through a check valve 90 into the lower liquid space of the primary smoke cooling chamber. Smoke is drawn from the deentrainment chamber by a smoker drawing on the projecting mouthpiece end of a tube 91.

It will be readily apparent that the present invention differs from the device of FIG. 5 in several important respects. The prior device released smoke downwardly through a single opening to provide a less effective bubble-forming action. It provided a deentrainment chamber which drained from its upper end rather than its lower portion, thus being less effective in its utilization of the volume of the device; and, it used a tubular mouthpiece rather than the uncomplicated but effective mouthpiece of the present invention.

Single Stage Model

Figure 6:
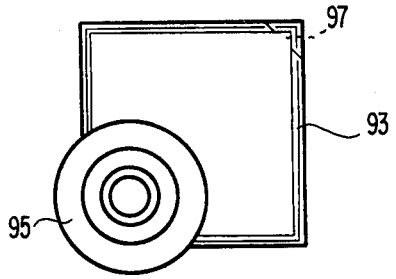
FIG. 6 is a plan view of a pipe embodying certain features of the invention, formed in a transparent box.
Figure 7:
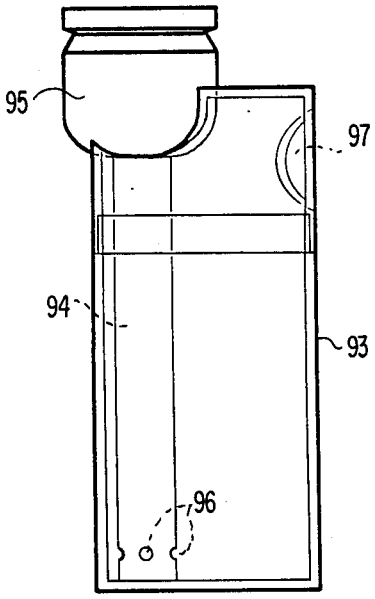
FIG. 7 is an elevational view of the pipe of FIG. 6.
Figure 8:
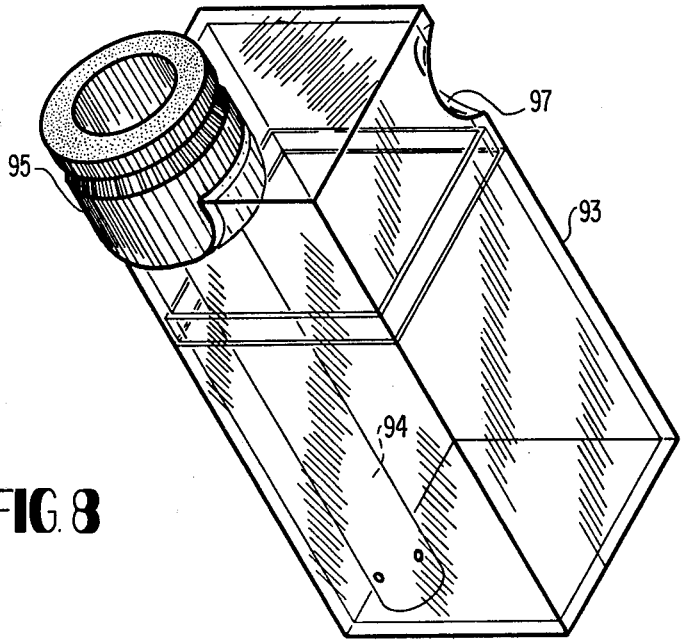
FIG. 8 is a perspective view of the pipe of FIG. 6.

A single stage pipe which utilizes a bubble former and a mouthpiece according to the invention is shown in FIGS. 6–8 which are identical to the drawings in a pending application for design patent. This pipe has a single cooling chamber within the transparent box 93. A tube 94 leads from the bowl 95 into the water located in the chamber. Radiating circular openings 96 in the lower portions of tube 94 form plural streams of bubbles which are cooled and humidified as they ascend through the water. The smoke is withdrawn through the cut edge mouthpiece opening 97. In use, the pipe is held in an inclined position, the smoker holding it in a flute-like position as he draws or tokes on the device.

Modular Model

Figure 9:
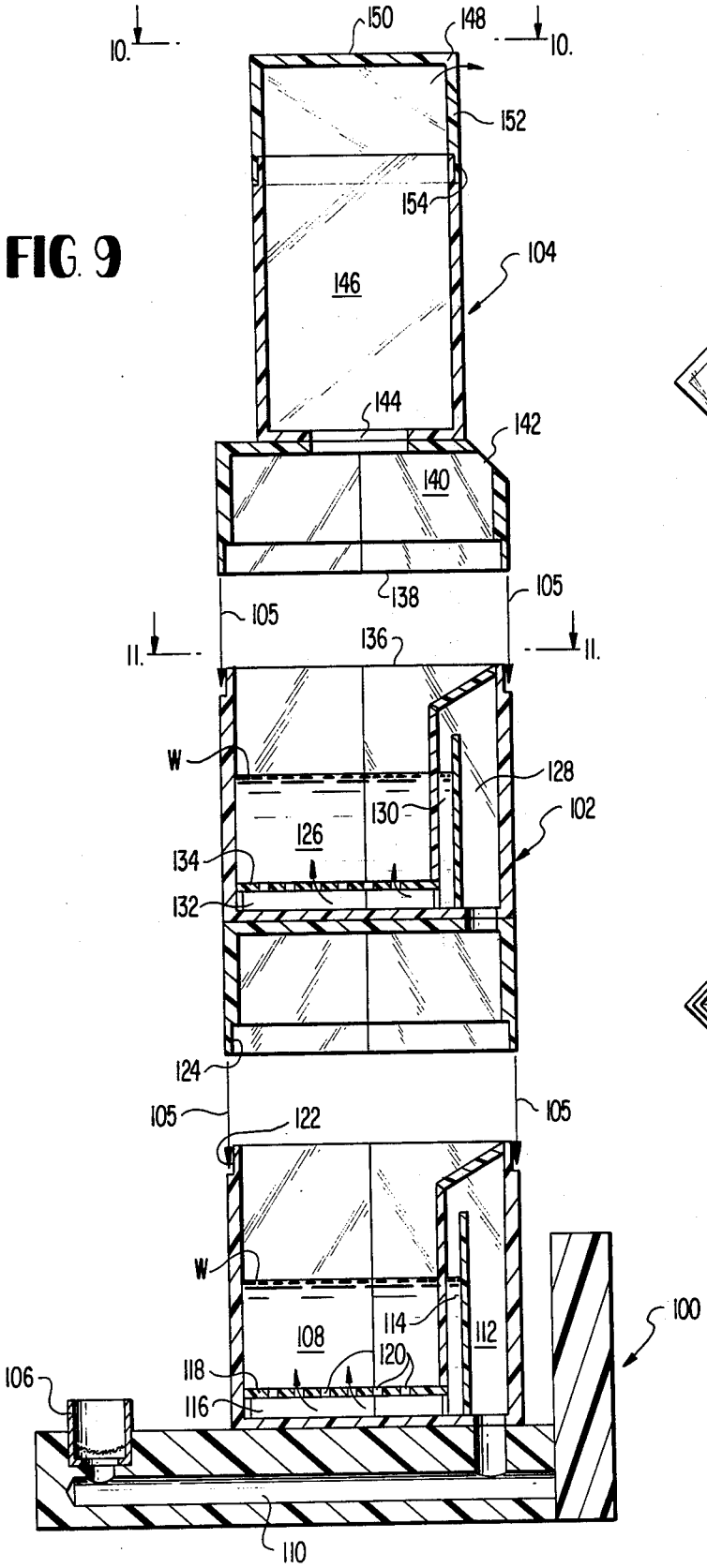
FIG. 9 is an exploded sectional view of a pipe constructed according to the invention, and being formed of a plurality of interconnectible modules.
Figure 10:
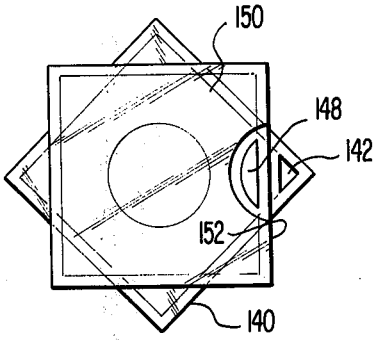
FIG. 10 is a plan view of the upper module of the pipe of FIG. 9, as seen along the line 10—10 in FIG. 9.
Figure 11:
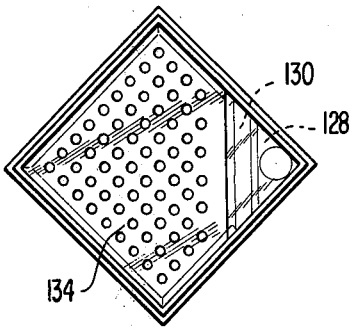
FIG. 11 is a plan view of the intermediate module of the pipe of FIG. 9, as seen along the line 11—11 in FIG. 9.

FIGS. 9, 10 and 11 illustrate a pipe with a plurality of interconnectible modules which collectively form a multiple stage waterpipe. The modules are designed to enable a purchaser to provide as many smoke-cooling stages as desired, simply by purchasing additional modules.

FIG. 9 shows a base module 100, an intermediate module 102 and an upper module 104, these modules being interfitted by moving them together as indicated by arrows 105. The base module 100 holds the combustible smoking material and provides a first cooling stage; the intermediate module provides a second cooling stage; and, the upper module 104 provides a carburetion chamber and an outlet for the cooled smoke. The basic model of this pipe will include only the modules 100 and 104, the smoker being given the option to purchase intermediate modules 102 as desired.

The base module 100 includes a bowl 106 for holding tobacco or other combustible smoking material, and a chamber or vessel 108 which holds water to level W for cooling the smoke generated by the smoking material. Smoke is carried from the bowl into the liquid by a series of passages including a horizontal passage 110, an upflow smoke inlet passage 112 which extends upwardly to an elevation above the water level W in vessel 108, and a downflow smoke inlet passage 114 which leads from the upper end of upflow passage 112 to an air distribution chamber 116.

Chamber 116 lies beneath the water level in vessel 108 and is provided with an upper wall 118 formed with a plurality of apertures 120. The apertures 120 break the smoke into a plurality of small streams which form bubbles as they rise through the water in vessel 108. The bubbles of smoke are cooled by the water, and they ultimately break to release the cooled smoke into the upper air space above the water level in vessel 108.

The upper end of base module 100 is an outlet which is coupled to the lower inlet end of intermediate module 102 by a joint connection. The illustrated joint is constructed integrally with the modules, the upper outlet end of base module 100 being exteriorily recessed at 122 and the lower inlet end of intermediate module 102 being interiorly recessed at 124 to provide a telescopic connection. Other joint means are suitable and may be either integral with or separable from the modules.

The intermediate module 102 is similar in many respects to the base module 100. It has a chamber or vessel 126 which is partially filed with water to level W, providing a lower liquid space and an upper air space. Its smoke inlet passage is formed of an upflow passage 128 for carrying smoke from the upper air space of vessel 108 to the elevation of the upper air space of vessel 126, and a downflow passage 130 which then carries the smoke downwardly into the lower liquid space via the chamber 132 and apertured plate 134, the latter being the same as plate 118 in the base module 100. As in the base module, bubbles of smoke ascending through the water are cooled and then break to release smoke in the upper air space of vessel 126. This smoke is then carried from the upper outlet end 136 of intermediate module 102 to the lower inlet end 138 of the upper module 104. The disclosed joint for connecting modules 102 and 104 is substantially the same as previously described for connecting modules 100 and 102.

Upper module 104 has a carburetion chamber 140 wherein supplemental air may enter port 142 to admix with the cooled smoke. The port 142 is formed by removing a corner from the module as shown in FIG. 10. The amount of supplemental air introduced is simply controlled by the smoker's fingertip placed on the port 142.

The cooled, carbureted smoke then is carried through opening 144 into chamber 146 which it exits through a mouthpiece opening 148 formed by cutting away portions of the top wall 150 and side wall 152 in their area of intersection. The smoker's lips are placed against the walls 150 and 152 to surround the walls as the smoker draws on the pipe. In lieu of the cut edge mouthpiece, the pipe may be provided with a cap connected at joint 154 which has a plurality of flexible tubes, enabling simultaneous use of the pipe by two or more smokers.

An important advantage of the pipe shown in FIGS. 6, 7 and 8 is that the number of smoke-cooling stages is easily increased or decreased to conform with the preferences of the smoker. This is achieved by adding or removing intermediate modules 102–a measure made quite convenient if, as illustrated, the joint at the outlet end of the intermediate module 102 is geometrically identical to the joint at the outlet end of the base module 100 and complementary to the joint at the inlet end of the intermediate module 102. This permits simple disassembly and insertion or removal of the intermediate modules.

Persons working in the field of this invention will realize that the inventive features disclosed herein may be used separately or in combination with each other. For example, the modular pipe system of FIGS. 6–8 may be constructed without the cut mouthpiece and the multi-apertured bubble former. Each module may be formed of separable parts and the modules may be in a side-by-side relationship rather than the disclosed vertical array.

Likewise, the perforate tube bubble former may be located in cooling stages which are subsequent to the first cooling stage. A perforate sheet bubble former may be provided in a first cooling stage. Either type of bubble former may be used in a pipe which has a single cooling stage.

The deentrainment chamber, while preferably used in a pipe which has multiple cooling stages, may be provided in a pipe which has only a single stage. In such a device, the liquid drain opening may lead to an auxiliary chamber or passage which is in communication with the bottom of the cooling chamber.

The foregoing are only examples of smoker's pipes which utilize the principles of the invention. Many other variations and modifications will be envisioned by persons working in this field. Accordingly, it is emphasized that the invention is not limited to the disclosed embodiments, but encompasses a wide variety of pipes falling within the spirit of the following claims.

I claim:

1. A smoker's pipe, comprising, a means for producing smoke, a chamber means formed within a housing means, said housing means including a plurality of intersecting walls, said chamber means being subdivided into a deentrainment subchamber means for preventing fluid entrained in the smoke from reaching the smoker, and a smoke-cooling subchamber means containing a volume of fluid, smoke inlet means operatively connecting said means for producing smoke with said smoke-cooling subchamber means, for introducing smoke into said smoke-cooling subchamber, one end of said smoke inlet means being disposed within said fluid, a smoke outlet opening means for withdrawing smoke from said chamber, located substantially at the intersection of at least two of said walls defining said chamber, whereby a smoker's lips may be placed respectively against said two of said walls to surround said smoke outlet opening means, and whereby a reduced pressure at said smoke outlet opening means will draw smoke from said smoke-producing means through said smoke inlet means and into said chamber, said deentrainment subchamber means being operatively connected to said smoke-cooling subchamber means and to said smoke outlet opening means, said connection between said deentrainment subchamber means and said smoke-cooling subchamber means including gravitational drain means connected to said deentrainment subchamber means near their bottom, for channelling deentrained fluid back into said smoke-cooling subchamber between draughts, said gravitational drain means including check valve means disposed so as to substantially prevent the passage of fluid and smoke through said gravitational drain means when the pressure in said smoke-cooling subchamber substantially exceeds that in said deentrainment subchamber.

2. The pipe of claim 1 wherein said two of said walls are planar.

3. The pipe of claim 2 wherein said two of said walls are in planes which are at an angle of about 60° to 120° with respect to each other.

4. The pipe of claim 1 wherein said smoke-cooling subchamber means are further subdivided into a primary smoke-cooling subchamber means and a secondary smoke-cooling subchamber means, said primary smoke-cooling subchamber means being operatively connected to said smoke inlet means and to said secondary smoke-cooling subchamber means, and to said deentrainment subchamber means through said gravitational drain means, and containing a portion of said volume of fluid, said end of said smoke inlet means being disposed within said portion, said secondary smoke-cooling subchamber means being operatively connected to said primary smoke-cooling subchamber means by way of smoke passageway means, and to said deentrainment means by means other than said gravitational drain means, and containing a portion of said volume of fluid, said smoke passageway means having one end disposed within said portion of fluid residing within said secondary smoke-cooling subchamber means.

5. The pipe of claim 1 wherein said smoke-cooling subchamber means reside in a single vessel, said vessel being provided with partition means which form the upper boundary of said smoke-cooling subchamber means and the lower boundary of said deentrainment subchamber means.

6. The pipe of claim 5 wherein said partition means are inclined downwardly toward the point of connection between said gravitational drain means and said deentrainment subchamber means.

7. The pipe of claim 6 wherein said smoke-cooling subchamber means are further subdivided into a primary smoke-cooling subchamber means and a secondary smoke-cooling subchamber means, said primary smoke-cooling subchamber means being operatively connected to said smoke inlet means and to said secondary smoke-cooling subchamber means, and to said deentrainment subchamber means through said gravitational drain means, and containing a portion of said volume of fluid, said end of said smoke inlet means being disposed within said portion, said secondary smoke-cooling subchamber means being operatively connected to said primary smoke-cooling subchamber means by way of smoke passageway means, and to said deentrainment subchamber means by means other than said gravitational drain means, and containing a portion of said volume of fluid, said smoke passageway means having one end disposed within said portion of fluid residing within said secondary smoke-cooling subchamber means.

* * * * *